US012702907B2

(12) United States Patent
Chen

(10) Patent No.: US 12,702,907 B2
(45) Date of Patent: Aug. 11, 2026

(54) SHOCK ABSORBING STRUCTURE OF RACKET

(71) Applicants: Dennis Chen, Taichung City (TW); SUREWIN WORLDWIDE LIMITED, Apia (WS)

(72) Inventor: Dennis Chen, Taichung City (TW)

(73) Assignees: Dennis Chen, Taichung City (TW); SUREWIN WORLDWIDE LIMITED, Apia (WS)

( * ) Notice: Subject to any disclaimer, the term of this patent is extended or adjusted under 35 U.S.C. 154(b) by 889 days.

(21) Appl. No.: 18/151,098

(22) Filed: Jan. 6, 2023

(65) Prior Publication Data

US 2023/0233916 A1 Jul. 27, 2023

(30) Foreign Application Priority Data

Jan. 21, 2022 (TW) ..... 111200908

(51) Int. Cl.
*A63B 60/54* (2015.01)
*A63B 49/10* (2015.01)
(Continued)

(52) U.S. Cl.
CPC ..... *A63B 60/54* (2015.10); *A63B 49/10* (2013.01); *A63B 49/12* (2013.01);
(Continued)

(58) Field of Classification Search
CPC ..... A63B 60/54; A63B 49/10; A63B 49/12; A63B 2102/02; A63B 2102/04;
(Continued)

(56) References Cited

U.S. PATENT DOCUMENTS 3,664,668 A * 5/1972 Held ..... A63B 49/14 473/545
4,983,242 A * 1/1991 Reed ..... B32B 5/10 264/258

(Continued)

FOREIGN PATENT DOCUMENTS

EP 586832 A1 * 3/1994

*Primary Examiner* — Jeffrey S Vanderveen
(74) *Attorney, Agent, or Firm* — LANWAY IPR SERVICES; Chun-Ming Shih

(57) ABSTRACT

A shock absorbing structure of a racket contains: a head and an absorption member matingly contacting with an internal fence of the head. The absorption member is a hollowly tubular structure and covers the internal fence totally. When the head is made of carbon-fiber composite material, the absorption member is made of any one of Thermoplastic Elastomer (TPE), Thermoplastic Rubber (TPR), rubber, Hydrogel, and Thermoplastic Polyurethane (TPU). When the head is made of metal or aluminum alloy, the absorption member is made of any one of Thermosetting Elastomers, Thermoplastic Elastomer (TPE), Thermoplastic Rubber (TPR), rubber, Hydrogel, and Thermoplastic Polyurethane (TPU). When the head and the absorption member are made of different materials, an amplitude of the head is different from an amplitude of the absorption member, and the head interferes the absorption member, thus absorbing vibration.

7 Claims, 5 Drawing Sheets

(51) Int. Cl.

| | |
|---|---|
| ***A63B 49/12*** | (2015.01) |
| ***A63B 102/02*** | (2015.01) |
| ***A63B 102/04*** | (2015.01) |
| ***A63B 102/06*** | (2015.01) |

(52) U.S. Cl.
CPC ..... *A63B 2102/02* (2015.10); *A63B 2102/04* (2015.10); *A63B 2102/06* (2015.10); *A63B 2209/02* (2013.01)

(58) Field of Classification Search
CPC ..... A63B 2102/06; A63B 2209/02; A63B 2209/00; A63B 49/02; A63B 60/52
See application file for complete search history.

(56) References Cited

U.S. PATENT DOCUMENTS

| | | | | |
|---|---|---|---|---|
| 5,135,223 | A * | 8/1992 | You | A63B 60/54 473/523 |
| 2003/0073523 | A1* | 4/2003 | Hsu | A63B 60/00 473/535 |
| 2005/0003911 | A1* | 1/2005 | Yu | A63B 49/022 473/521 |
| 2015/0224370 | A1* | 8/2015 | Yamamoto | A63B 49/10 156/185 |

* cited by examiner

SHOCK ABSORBING STRUCTURE OF RACKET

FIELD OF THE INVENTION

The present invention relates to a sport ball equipment tool, and more particularly to shock absorbing structure of a racket which includes a handle, a connection tube, and a frame.

BACKGROUND OF THE INVENTION

For ball sports such as tennis, badminton, and squash that use hollow tubular handles, rods, or frames as rackets, the main action is to accurately hit the ball back. However, if the racket produces too much vibration when hitting the ball, it will cause unstable ball control and easily cause sports injuries to the hands.

To reduce the vibration, many improvements are made on the frame or handle of the racket, and the method of hanging the shock absorber is often used, such as setting a groove in the frame of the racket, inserting a shock absorbing block in the groove, or a network cable around the frame of the racket There are methods such as hanging shock absorbers. However, the shock absorber cannot be firmly fixed, and it is easy to fall due to the shock. If it is not installed properly, it will not only increase the weight of the racket, but may also change its center of gravity, resulting in poor handling. In addition, the effect of the external shock absorber is not satisfactory, and it cannot really effectively reduce the powerful impact force at the moment of hitting the ball.

The present invention has arisen to mitigate and/or obviate the afore-described disadvantages.

SUMMARY OF THE INVENTION

The primary object of the present invention is to provide a shock absorbing structure of a racket which is capable of overcoming the shortcomings of the conventional shock absorbing structure of the racket.

To obtain above-mentioned objective, a shock absorbing structure of a racket provided by the present invention contains: a head and an absorption member matingly contacting with an internal fence of the head. The absorption member is a hollowly tubular structure and covers the internal fence totally.

When the head is made of carbon-fiber composite material, the absorption member is made of any one of Thermoplastic Elastomer (TPE), Thermoplastic Rubber (TPR), rubber, Hydrogel, and Thermoplastic Polyurethane (TPU).

When the head is made of metal or aluminum alloy, the absorption member is made of any one of Thermosetting Elastomers, Thermoplastic Elastomer (TPE), Thermoplastic Rubber (TPR), rubber, Hydrogel, and Thermoplastic Polyurethane (TPU).

The absorption member matingly contacts with the internal fence of the heat, thus avoiding a removal of the absorption member and enhancing reinforcement of the racket.

When the head and the absorption member are made of different materials, an amplitude of the head is different from an amplitude of the absorption member, and the head interferes the absorption member, thus absorbing vibration.

DETAILED DESCRIPTION OF THE PREFERRED EMBODIMENTS

Figure 1:
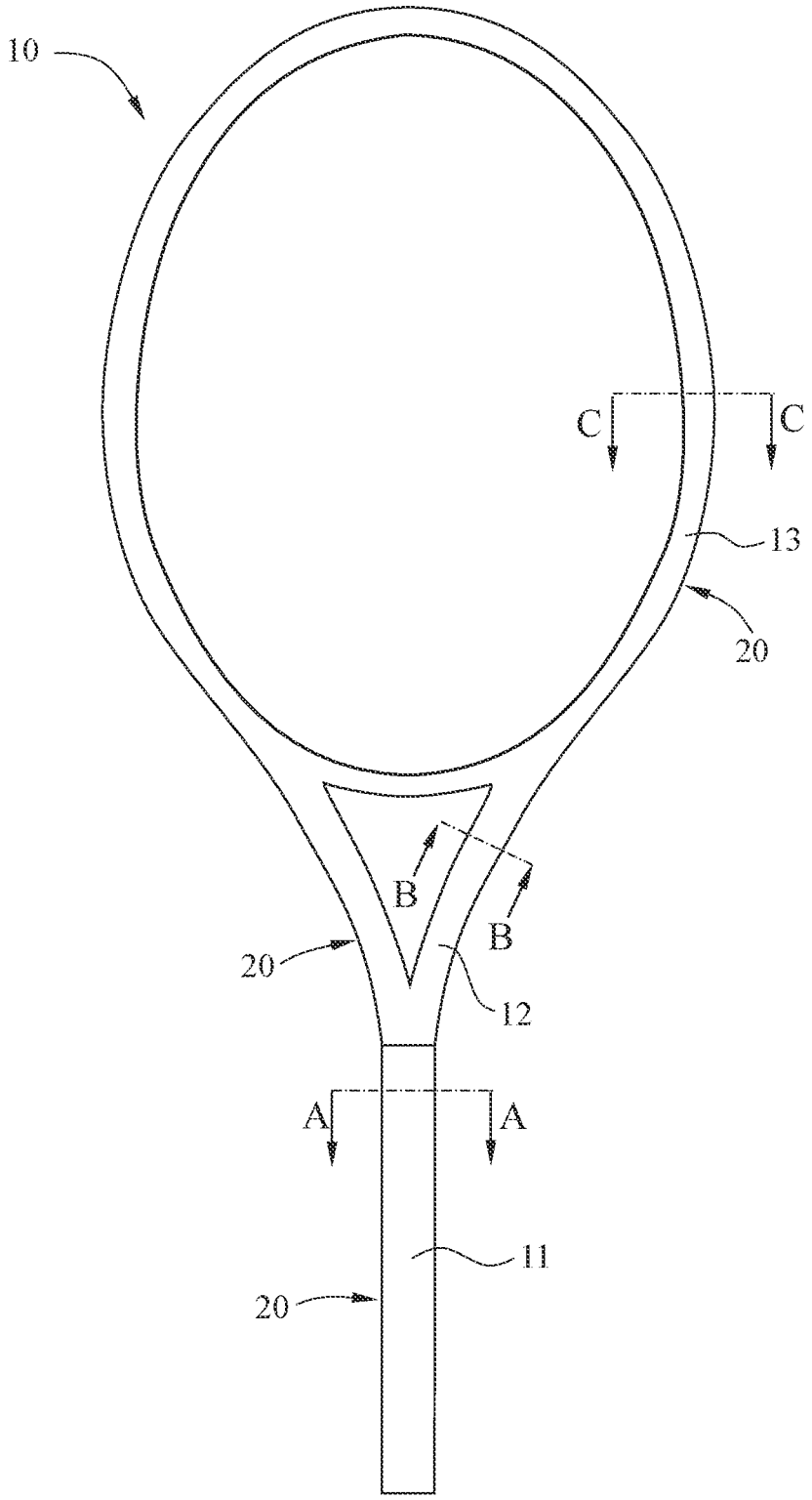
FIG. 1 is a side plan view showing the assembly of a shock absorbing structure of a racket according to a first embodiment of the present invention.
Figure 2:
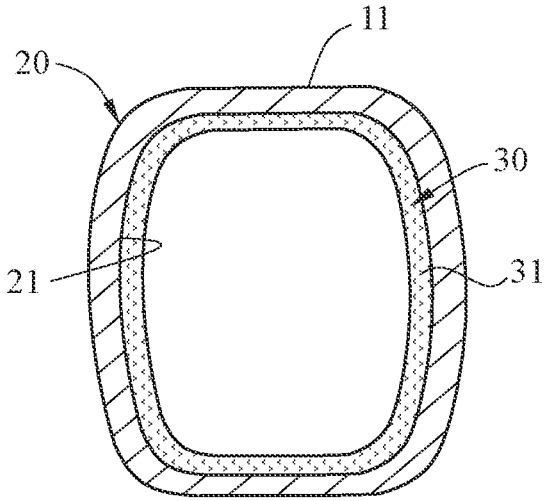
FIG. 2 is a cross sectional view taken along the line of A-A of FIG. 1 according to the first embodiment of the present invention.
Figure 3:
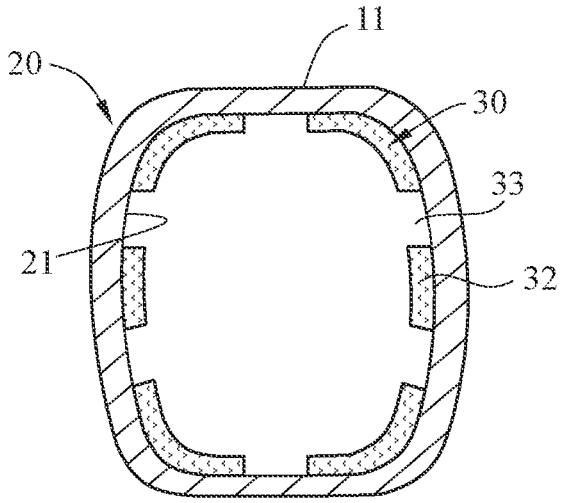
FIG. 3 is a cross sectional view taken along the line of A-A of FIG. 1 according to a second embodiment of the present invention.
Figure 4:
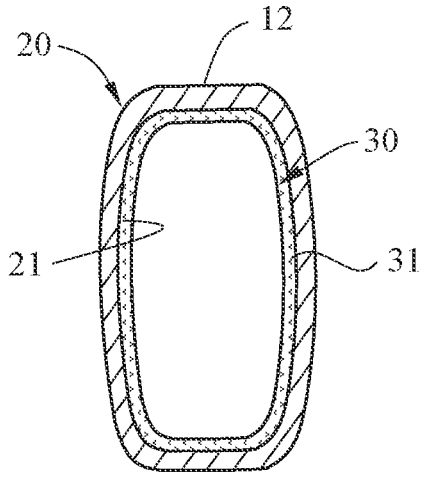
FIG. 4 is a cross sectional view taken along the line of B-B of FIG. 1 according to the first embodiment of the present invention.
Figure 5:
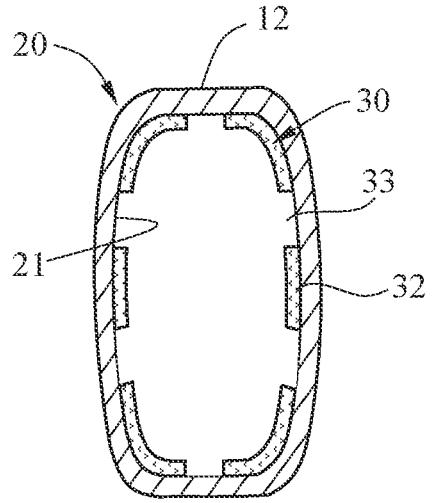
FIG. 5 is a cross sectional view taken along the line of B-B of FIG. 1 according to the second embodiment of the present invention.
Figure 6:
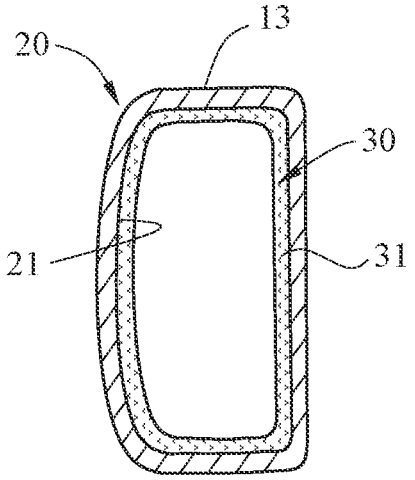
FIG. 6 is a cross sectional view taken along the line of C-C of FIG. 1 according to the first embodiment of the present invention.
Figure 7:
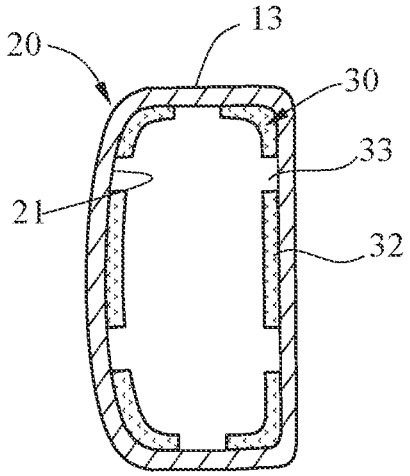
FIG. 7 is a cross sectional view taken along the line of C-C of FIG. 1 according to the second embodiment of the present invention.

With reference to FIGS. 1-7, a shock absorbing structure of a racket (such as a tennis racket 10) according to a preferred embodiment of the present invention, the tennis racket 10 comprises a head 20. Alternatively, the racket is a badminton racket or a squash racket.

Figure 8:
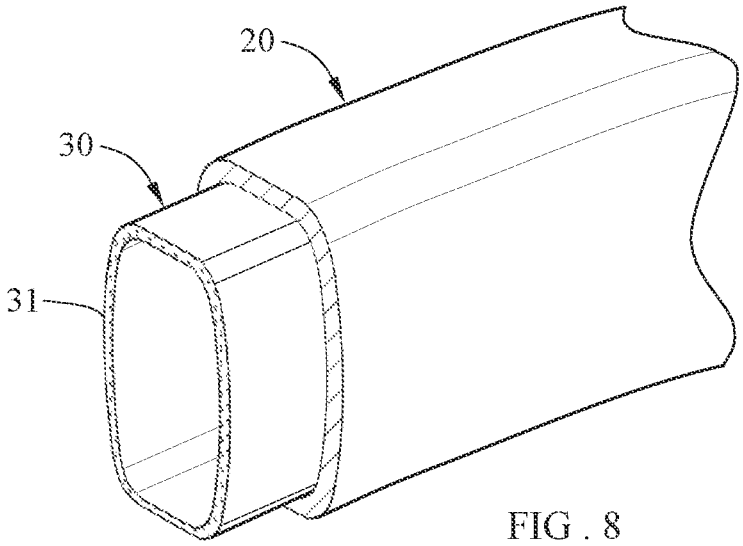
FIG. 8 is a cross-sectional perspective view showing a part of the shock absorbing structure of the racket according to the first embodiment of the present invention.
Figure 9:
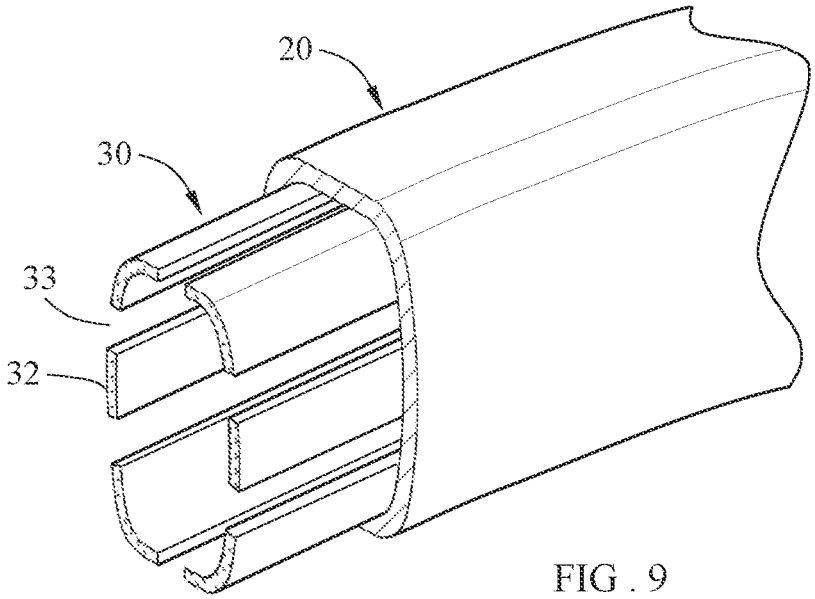
FIG. 9 is a cross-sectional perspective view showing a part of the shock absorbing structure of the racket according to the second embodiment of the present invention.

The tennis racket 10 includes a handle 11, a connection tube 12, and a frame 13 which are tubular and are configured to define and surround the head 20, wherein the head 20 includes an absorption member 30 matingly contacting with an internal fence 21 of the head 20. Referring to FIGS. 2, 4, 6 and 8, the absorption member 30 is a hollowly tubular structure 31 and covers the internal fence 21 totally. As shown in FIGS. 3, 5, 7 and 9, the absorption member 30 is multiple parallel straps 32 separately arranged on the internal fence 21 of the head 20, wherein a gap 33 is defined between any two adjacent parallel straps 32, and a part of the internal fence 21 corresponding to the gap 33 is not covered by the absorption member 30; an area of the other of the internal fence 21 covered by the absorption member 30 is more than an area of the part of the internal fence 21 which is not covered by the absorption member 30. In addition, a corner of the internal fence 21 of the head 20 is covered by the absorption member 30.

When the head 20 is made of carbon-fiber composite material, the absorption member 30 is made of any one of Thermoplastic Elastomer (TPE), Thermoplastic Rubber (TPR), rubber, Hydrogel, and Thermoplastic Polyurethane (TPU). When the head 20 is made of metal or aluminum alloy, the absorption member 30 is made of any one of Thermosetting Elastomers, Thermoplastic Elastomer (TPE), Thermoplastic Rubber (TPR), rubber, Hydrogel, and Thermoplastic Polyurethane (TPU). When the head 20 and the absorption member 30 are made of different materials, an amplitude of the head 20 is different from an amplitude of the absorption member 30, and the head 20 interferes the absorption member 30, thus absorption vibration.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A shock absorbing structure of a racket comprising:

a head and an absorption member matingly contacting with an internal fence of the head;

wherein the absorption member is multiple parallel straps;

wherein the multiple parallel straps of the absorption member are separately arranged on the internal fence of the head, and a gap is defined between any two adjacent parallel straps wherein an area of a part of the internal fence covered by the absorption member is more than an area of the other of the internal fence which is not covered by the absorption member.

2. The shock absorbing structure as claimed in claim 1, wherein the absorption member is a hollowly tubular structure and covers the internal fence totally.

3. The shock absorbing structure as claimed in claim 1, wherein a corner of the internal fence of the head is covered by the absorption member.

4. The shock absorbing structure as claimed in claim 1, wherein when the head is made of carbon-fiber composite material, the absorption member is made of any one of Thermoplastic Elastomer (TPE), Thermoplastic Rubber (TPR), rubber, Hydrogel, and Thermoplastic Polyurethane (TPU).

5. The shock absorbing structure as claimed in claim 1, wherein when the head is made of metal or aluminum alloy, the absorption member is made of any one of Thermosetting Elastomers, Thermoplastic Elastomer (TPE), Thermoplastic Rubber (TPR), rubber, Hydrogel, and Thermoplastic Polyurethane (TPU).

6. The shock absorbing structure as claimed in claim 1, wherein the racket is any one of a tennis racket, a badminton racket and a squash racket.

7. The shock absorbing structure as claimed in claim 6, wherein the tennis racket includes a handle, a connection tube, and a frame which are tubular and are configured to define and surround the head.

* * * * *